US007410230B2

(12) United States Patent
Anderson et al.

(10) Patent No.: US 7,410,230 B2
(45) Date of Patent: Aug. 12, 2008

(54) REFRIGERATOR WITH MULTI-PIECE MULLION HAVING STEPPED OFFSET

(75) Inventors: Troy M. Anderson, Marion, IA (US); Garnett S. Helming, Cedar Rapids, IA (US); Douglas A. Pohl, Benttendorf, IA (US); Eugene H. Schuchert, Iowa City, IA (US); Forrest F. Wing, Des Moines, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 474 days.

(21) Appl. No.: 11/033,558

(22) Filed: Jan. 12, 2005

(65) Prior Publication Data

US 2006/0152125 A1 Jul. 13, 2006

(51) Int. Cl.
*A47B 96/04* (2006.01)

(52) U.S. Cl. ..... 312/407; 312/401

(58) Field of Classification Search ..... 312/401, 312/402, 405, 406, 406.1, 406.2, 407, 407.1; 62/441, 447; 49/501; 52/716.6, 716.7, 718.04, 52/718.05

See application file for complete search history.

(56) References Cited

U.S. PATENT DOCUMENTS

| | | | | | |
|---|---|---|---|---|---|
| 3,726,578 | A | | 4/1973 | Armstrong | |
| 4,258,856 | A | * | 3/1981 | Marling | 52/239 |
| 4,558,503 | A | * | 12/1985 | Wilson | 312/407 |
| 4,822,117 | A | * | 4/1989 | Boston, Jr. | 312/257.1 |
| 4,898,285 | A | * | 2/1990 | Field | 52/718.04 |
| 4,955,676 | A | * | 9/1990 | Weaver et al. | 312/407 |
| 5,388,904 | A | * | 2/1995 | Kuwahara et al. | 312/406.2 |
| 5,454,198 | A | * | 10/1995 | Aulson | 52/716.6 |
| 5,645,330 | A | | 7/1997 | Artwohl et al. | |
| 5,720,536 | A | * | 2/1998 | Jenkins et al. | 312/406.2 |
| 5,897,181 | A | | 4/1999 | Avendano et al. | |
| 5,899,546 | A | | 5/1999 | Avendano et al. | |
| 5,992,960 | A | * | 11/1999 | Wolanin | 312/407 |
| D418,845 | S | | 1/2000 | Jackovin | |
| 6,019,447 | A | * | 2/2000 | Jackovin | 312/405 |
| 6,036,292 | A | | 3/2000 | Mandel et al. | |
| D431,577 | S | | 10/2000 | Jackovin | |
| 6,350,002 | B1 | * | 2/2002 | Takaoka et al. | 312/407 |
| 6,926,379 | B1 | * | 8/2005 | Grace et al. | 312/405 |
| 2002/0112423 | A1 | * | 8/2002 | Schiedegger et al. | 52/718.04 |

FOREIGN PATENT DOCUMENTS

| | | | | |
|---|---|---|---|---|
| JP | 53067258 | * | 6/1978 | 312/406 |

* cited by examiner

*Primary Examiner*—Lanna Mai
*Assistant Examiner*—Hanh V Tran
(74) *Attorney, Agent, or Firm*—Kirk Goodwin; Michael D. Lafrenz

(57) ABSTRACT

A side-by-side refrigerator includes a cabinet defining fresh food and freezer compartments, each having upper and lower sections which vary in width and volume along with corresponding fresh food and freezer doors that vary in width. The fresh food and freezer compartments are spaced by an offset mullion assembly against which the doors seal. The offset mullion assembly includes a first longitudinal member, a second longitudinal member, a brace having first and second legs and a laterally extending portion and a cosmetic cover. The offset mullion assembly provides strength to the cabinet while providing an aesthetically pleasing and uniform sealing surface for the fresh food and freezer doors.

7 Claims, 4 Drawing Sheets

REFRIGERATOR WITH MULTI-PIECE MULLION HAVING STEPPED OFFSET

BACKGROUND OF THE INVENTION

1. Field of the Invention

The present invention generally relates to a refrigerator cabinet and, more specifically, to a mullion arrangement for a side-by-side refrigerator cabinet having laterally spaced, varying width compartment doors.

2. Discussion of the Prior Art

A conventional refrigerator is defined by insulated freezer and fresh food compartments which are disposed in either a side-by-side or a vertically spaced configuration. Generally, integrally molded fresh food and freezer liners are used for defining interior storage compartments of the cabinet. More specifically, a conventional refrigerator cabinet is typically defined by an outer shell that is formed from sheet metal to which is attached, at a front face portion thereof, a mullion bar that partitions the shell into two section. Each of the fresh food and freezer liners is inserted into a respective cabinet section while being mated with return flange portions of both the cabinet shell and the mullion bar. In the case of an offset side-by-side refrigerator, laterally spaced fresh food and freezer compartments each include upper and lower compartment sections having varying widths. Accordingly, a mullion arrangement in an offset side-by-side refrigerator must have a different configuration than that found in a conventional side-by-side refrigerator. More specifically, the mullion must include an upper vertical portion and a lower vertical portion interconnected by a laterally extending portion. The strain placed on this type of mullion assembly can be greater than that placed on a typical refrigerator mullion assembly due to the offset nature of the refrigerator compartments. Additionally, when the refrigerator compartment doors are opened, the appearance of the mullion assembly is particularly emphasized by the offset configuration of the refrigerator.

Based on the above, there exists a need in the art for a structurally sound refrigerator mullion having an aesthetically pleasing appearance. More specifically, there exists a need for an offset refrigerator mullion arrangement which is strong, easy to assemble and aesthetically pleasing.

SUMMARY OF THE INVENTION

The present invention is directed to a multi-piece mullion arrangement for a refrigerator having varying width fresh food and freezer doors. The varying width refrigerator includes a cabinet shell and at least one liner positioned within the cabinet shell in order to define laterally spaced, fresh food and freezer compartments separated by a fore-to-aft extending divider wall, with a multi-piece mullion assembly provided at the front of the divider wall. The mullion assembly includes an upper longitudinal portion and a lower longitudinal portion interconnected by a laterally extending brace. A cosmetic cover is also provided to give the assembly a finished look.

Preferably, varying width fresh food and freezer doors are provided which correspond to the varying width fresh food and freezer compartments. The fresh food and freezer doors each include an outer lateral portion pivotally mounted to the cabinet shell about a substantially vertical axis and an inner lateral portion defined by a laterally offset section. In this manner, the fresh food and freezer doors have vertically offset, varying width portions which are adapted to uniformly seal against the mullion assembly of the present invention.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
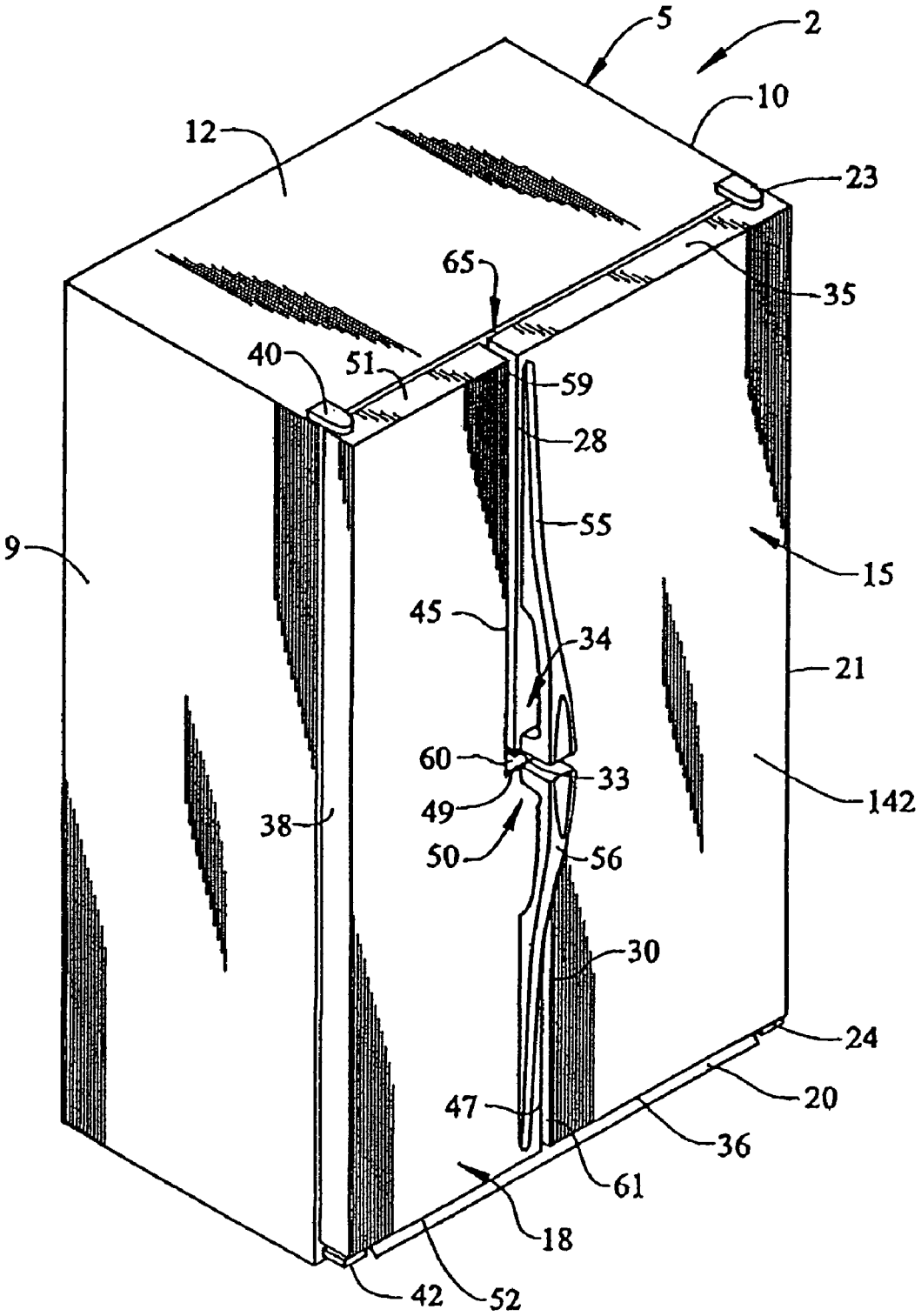
FIG. 1 is an upper left perspective view of a side-by-side refrigerator having varying width doors and an offset mullion assembly.

With initial reference to FIG. 1, a refrigerator cabinet constructed in accordance with a first preferred embodiment of the present invention is generally indicated at 2. In general, refrigerator cabinet 2 includes a cabinet shell 5 formed from side panels 9 and 10 which are interconnected by a top panel 12. Preferably, cabinet shell 5 is formed from bending a single piece of sheet metal in a manner known in the art. As illustrated, refrigerator cabinet 2 constitutes a side-by-side refrigerator having a fresh food compartment door 15 which is arranged laterally juxtaposed a freezer door 18. Extending laterally across cabinet shell 5, below fresh food and freezer doors 15 and 18 is a kickplate 20. As shown, fresh food door 15 includes an outer vertical edge portion 21 which is pivotally attached to cabinet shell 5 through an upper hinge 23 and a lower hinge 24. As further shown in FIG. 1, fresh food door 15 includes an upper inner edge portion 28, a lower inner edge portion 30 and a lateral edge portion 33 interconnecting the upper and lower inner edge portions 28 and 30. Therefore, upper and lower inner edge portions 28 and 30 are laterally spaced and extend in vertically offset planes or axes so as to form a laterally offset portion 34 of fresh food door 15. In addition, fresh food door 15 includes upper and lower edge portions 35 and 36 that connect vertical edge portion 21 with upper and lower inner edge portions 28 and 30 respectively.

In a generally similar manner, freezer door 18 includes an outer edge portion 38 which is pivoted at an upper hinge 40 and a lower hinge 42 for movement relative to cabinet shell 5. In addition, freezer door 18 includes an upper inner edge portion 45, a lower inner edge portion 47 and a lateral edge portion 49. At this point, it should be understood that, while lateral edge portions 33 and 49 are shown to extend generally horizontally, these lateral portions could be curvilinear, diagonal or the like without departing from the invention. In any event, upper inner edge portion 45, lower inner edge portion 47 and lateral edge portion 49 form an associated laterally offset portion 50 for freezer door 18. In a manner similar to that described with respect to fresh food door 15, freezer door 18 includes upper and lower edge portions 51 and 52 that interconnect outer edge portion 38 with upper and lower inner edge portions 45 and 47 respectively. Also shown in FIG. 1, fresh food door 15 is provided with a handle 55. Likewise freezer door 18 is provided with a corresponding handle 56.

With this construction, as opposed to a conventional side-by-side refrigerator wherein inner edge portions of fresh food and freezer doors would be spaced by a vertical, single axis gap, fresh food and freezer doors 15 and 18 are spaced in a central zone of refrigerator cabinet 2 by a gap that includes a first vertical component 59 between upper inner edge portions 28 and 45, a lateral component 60 between lateral edge portions 33 and 49, and a second vertical component 61 between lower inner edge portions 30 and 47. Therefore, fresh food door 15 is wider in an upper region thereof than in a lower portion. Correspondingly, freezer door 18 is wider in a lower portion than in an upper portion. As will become more fully evident below, fresh food and freezer doors 15 and 18 conceal corresponding fresh food and freezer compartments of refrigerator cabinet 2 which also have varying width upper and lower sections. In general, refrigerator cabinet 2 with this offset design is disclosed in co-assigned U.S. Pat. No. 6,019,447 which is incorporated herein by reference. Instead, the present invention is particularly directed to the structure of an offset refrigerator mullion assembly which is generally indicated at 65 and used in connection with properly sealing fresh food and freezer doors 15 and 18 as will be detailed fully below.

Figure 2:
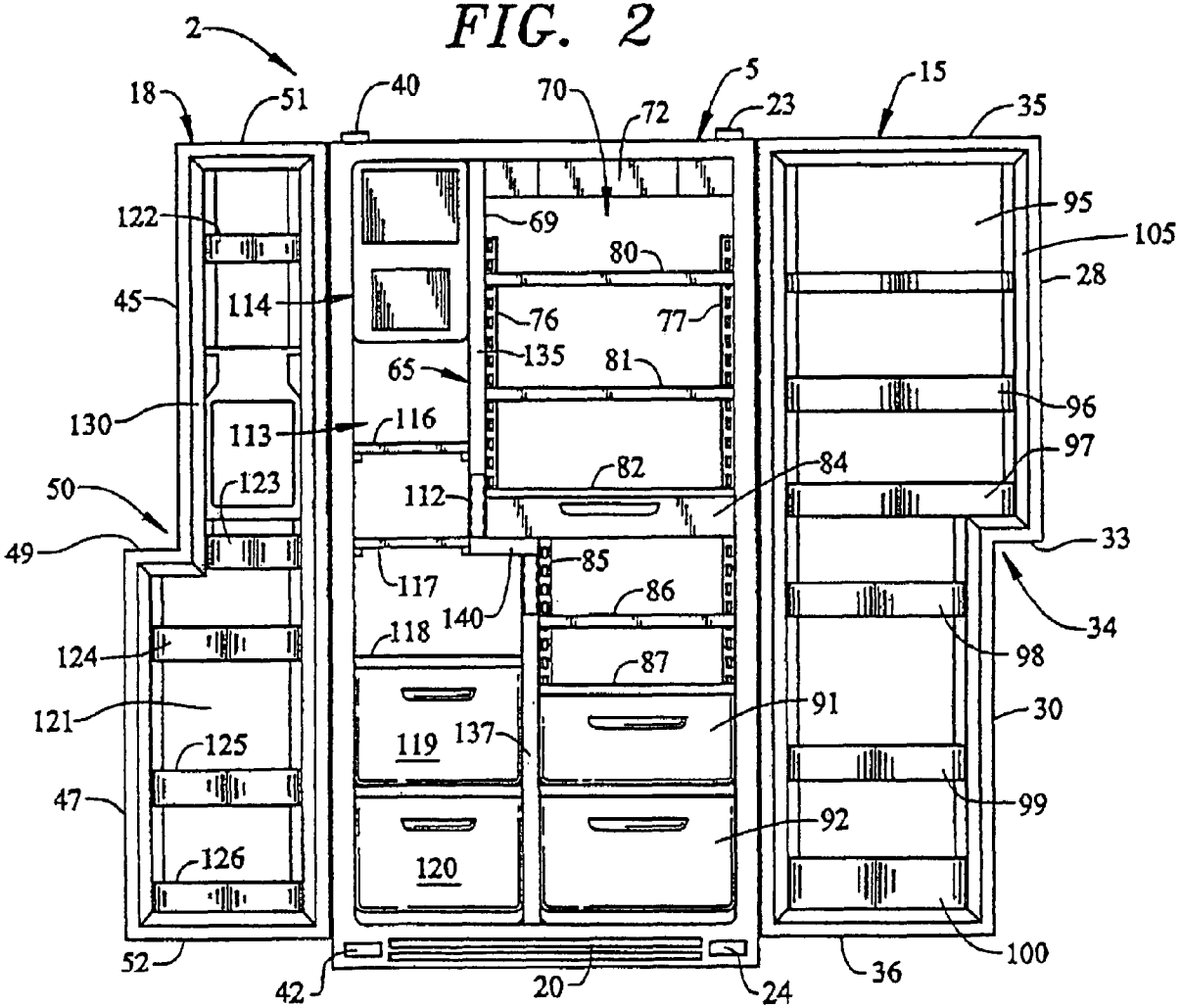
FIG. 2 is a front plan view of the side-by-side refrigerator of FIG. 1, with fresh food and freezer doors thereof shown open and the offset mullion assembly being exposed.

As best shown in FIG. 2 and provided for the sake of completeness, refrigerator cabinet 2 has mounted therein a liner 69 which defines a fresh food compartment 70. In the embodiment shown, a temperature control unit 72 is mounted at an upper portion of fresh food compartment 70 for controlling a temperature in fresh food compartment 70. In addition, laterally spaced vertical rails 76 and 77 are secured to rear wall portions of liner 69 in order to support vertically adjustable shelves 80-82. Shelf 82 is also shown to support a drawer 84. As shown in this figure, rail 77 extends below drawer 84 and is used in combination with a laterally offset intermediate rail 85 to support additional shelves 86 and 87. Finally, refrigerator cabinet 2 includes slidable storage bins 91 and 92 arranged at a lower portion of fresh food compartment 70.

Except for varying in width from typical side-by-side fresh food compartment shelves, drawers and bins, the construction and mounting of shelves 80-82, 86 and 87, drawer 84 and bins 91 and 92 correspond to more commonly known components in the art. Fresh food door 15 can also be provided with various food item storage units, such as shelves 96-99, a bin 100 and the like. Again, these storage units are known in the art and it is to be understood that they merely depict exemplary storage arrangements provided for the sake of completeness. In addition, it should be realized that fresh food door 15 includes a door seal or gasket 105, with door seal 105 extending about a door liner 95 and being generally spaced from, yet tracking, a perimeter defined by outer vertical edge 21, upper inner edge portion 28, lower inner edge portion 30, lateral edge portion 33, upper edge portion 35 and lower edge portion 36.

In a similar manner, a freezer liner 112 is mounted within cabinet shell 5 that defines a freezer compartment 113. In the embodiment shown, freezer compartment 113 has mounted therein an ice maker unit generally indicated at 114, various vertically spaced shelves 116-118 and lower most slidable bins 119 and 120. The inside of freezer door 18 includes a liner 121 and various shelves 122-126. Again, all of these food item supporting units are known in the art and have simply been sized to correspond to the various storage areas shown. In a manner similar to fresh food door 15, the inside of freezer door 18 is provided with a door seal or gasket 130, with door seal 130 extending about liner 121, generally spaced from, yet tracking, a perimeter defined by outer vertical edge 38, upper inner edge portion 45, lower inner edge portion 47, lateral edge portion 49, upper edge portion 51 and lower edge portion 52.

It should be realized that fresh food and freezer compartments 70 and 113 have varying width sections corresponding to that of fresh food and freezer doors 15 and 18. Accordingly, offset mullion assembly 65 has a different configuration than that found in more conventional side-by-side refrigerators. More specifically, mullion assembly 65 includes an upper elongated, longitudinal portion 135 and a lower elongated, longitudinal portion 137 which are interconnected by a laterally extending, central brace 140. Mullion assembly 65 can actually be interconnected to cabinet shell 5 in various ways. Preferably, mullion assembly 65 is interconnect to top and bottom flanges (not shown) of cabinet shell 5 through the use of mullion retainers (also not shown) in a manner corresponding to that set forth in co-assigned U.S. Pat. No. 5,992,960 which is incorporated herein by reference.

Particular reference will now be made to FIGS. 3 and 4 in describing the preferred construction of mullion assembly 65. Mullion assembly 65 includes an upper longitudinal mullion member or bar 135, a lower longitudinal mullion member or bar 137, laterally extending brace 140, and a snap-on cosmetic cover 143. Preferably, longitudinal bar 137 comprises steel plate having a planar body portion 150, a lip portion 152, and reversing flange structure generally indicated at 154 and 155. Reversing flange structures 154 and 155 have oppositely directed configurations and include wall portions 157 and 158 respectively, extending substantially perpendicularly relative to body portion 150. A space between wall portions 157 and 158 defines a channel 159. Further, wall portions 157 and 158 include connecting members or tabs 160, 161 and 162, 163 respectively. With this construction, reversing flange structures 154 and 155 define a pair of elongated slots or recesses 165 and 166 respectively, with slot 165 receiving a flange portion (not shown) of freezer liner 112, while slot 166 receives a flange portion (not shown) of fresh food liner 69. This interconnection between longitudinal bar 137 and liners 69 and 112 preferably occurs after mullion assembly 65 is attached to cabinet 2 through the flex-loading of liners 69 and 112.

The structure of longitudinal bar 135 is commensurate with the structure of longitudinal bar 137. Like longitudinal bar 137, longitudinal bar 135 includes a planar body portion 250, a lip portion 252 and reversing flange structure generally indicated at 254 and 255. Reversing flange structures 254 and 255 have oppositely directed configurations and include wall portion 257 and 258 respectively, extending substantially perpendicularly from body portion 250. A space between wall portions 257 and 258 defines a channel 259. Further, wall portions 257 and 258 include connecting members or tabs 260, 261 and 262, 263, respectively. With this construction, reversing flange structures 254 and 255 define a pair of elongated slots (not labeled) which are adapted to receive fresh food and freezer liners 69 and 112, respectively. In the most preferred embodiment, longitudinal bars 135 and 137 are roll-formed from steel and pre-painted prior to assembly in refrigerator 2. This provides longitudinal bars 135 and 137 with smooth, attractive front surfaces 168 and 268 as best shown in FIG. 4.

Preferably, brace 140 represents a steel plate formed into a channel bar having a generally U-shaped cross section. Brace 140 includes a base portion 350 and side portions 352 and 353 which project substantially perpendicularly from base portion 350. Base portion 350 includes a first leg portion 355 and a second leg portion 356 interconnected by a laterally extending portion 357. For reasons which will be detailed further below, side portions 352 and 353 of first leg portion 355 include connecting or tab receiving sections 360, 361 and 362, 363, respectively. Likewise, side portions 352 and 353 of second leg portion 356 include tab receiving sections 364, 365 and 366, 367, respectively. Laterally extending portion 357 includes tab receiving slots 370 and 371, as well as peg receiving holes 373 and 374.

Cover 143 is preferably made by co-injection molding a plastic frame 450 around a prepainted and textured steel plate insert 452. The resulting cover 143 includes resilient plastic tabs or snap-fit members 454-457 extending substantially perpendicularly from a body portion 460. Also extending substantially perpendicularly from body portion 460 are positioning pegs 462 and 463. Further, plastic frame 450 includes recessed lip receiving areas 465 and 466. The molded plastic frame 450 provides a front face portion 468 of cover 143 with an aesthetically pleasing surface which can be smooth or textured.

Figure 3:
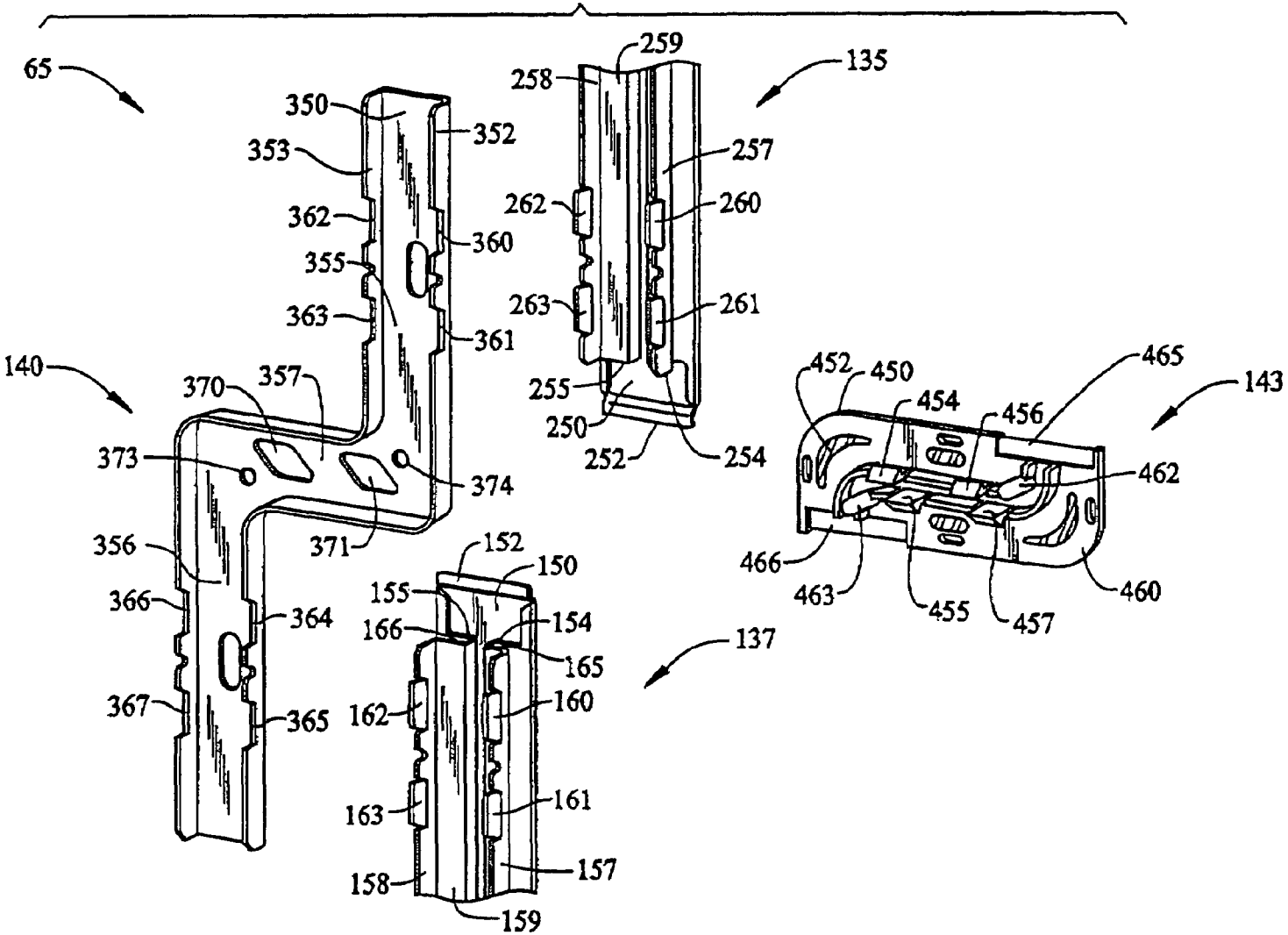
FIG. 3 is a rear, exploded view of the offset mullion assembly of the present invention.
Figure 4:
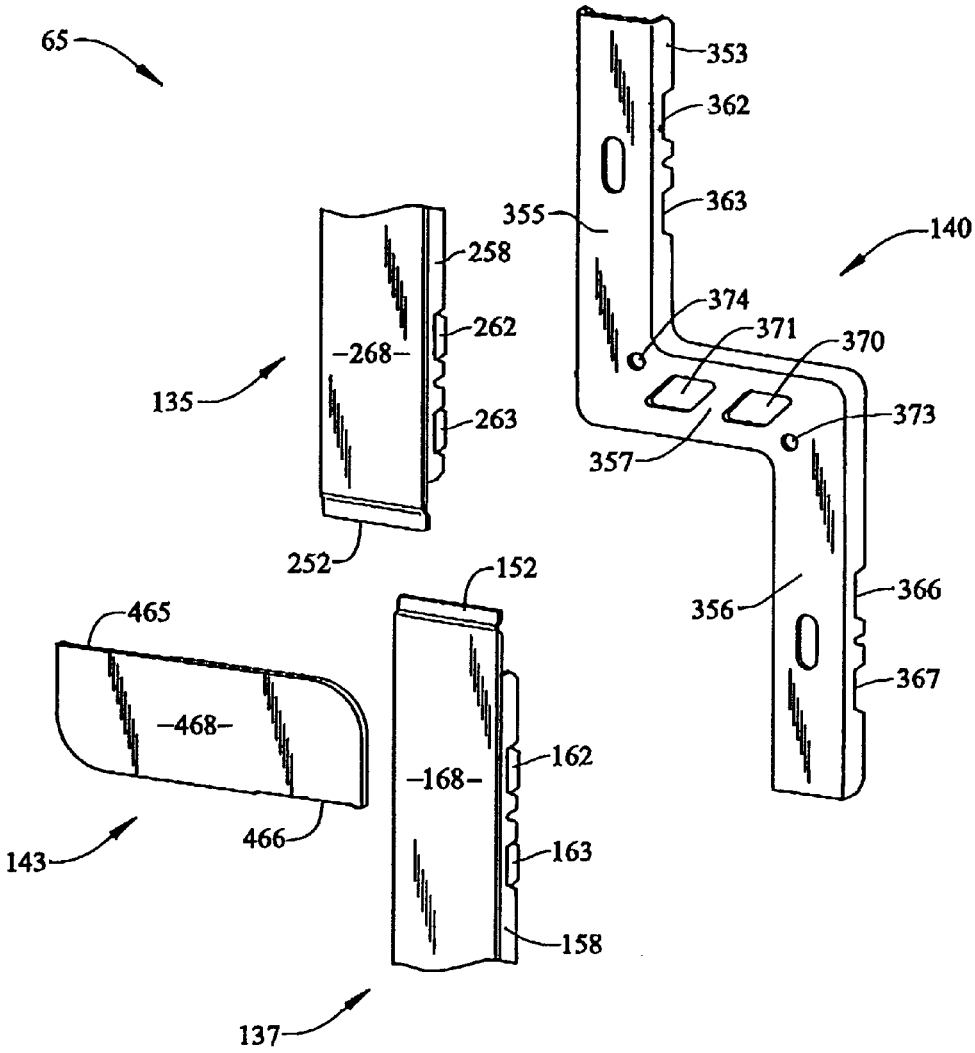
FIG. 4 is a front, exploded view of the offset mullion assembly of FIG. 3.

Reference will be further made to FIGS. 3 and 4 in describing the manner in which upper longitudinal bar 135, lower longitudinal bar 137 and cover 143 are connected with laterally extending brace 140. Channel 259 of longitudinal bar 135 is sized to receive first leg portion 355 of brace 140. As first leg portion 355 is inserted into channel 259, tabs 260 and 261 snap into tab receiving sections 360 and 361, respectively, and tabs 262 and 263 snap into tab receiving sections 362 and 363, respectively, thereby fixedly retaining leg portion 355 within channel 259. In a corresponding manner, channel 159 of longitudinal bar 137 is sized to receive second leg portion 356 of brace 140. As second leg portion 356 is inserted into channel 159, tabs 160 and 161 snap into tab receiving sections 364 and 365 and tabs 162 and 163 snap into tab receiving sections 366 and 367, thereby fixedly retaining leg portion 356 within channel 159.

Preferably, once longitudinal bars 135 and 137 are mounted to brace 140, cosmetic cover 143 is attached to complete mullion assembly 65. In order to attach cosmetic cover 143 to mullion assembly 65, pegs 462 and 463 of cover 143 are aligned with peg receiving holes 373 and 374, respectively, in brace 140. Tabs 454, 455 and 456, 457 of cover 143 are then snapped into tab receiving slots 370 and 371, respectively, thereby fixedly attaching cover 143 to brace 140. With cover 143 snapped into place, tongue portion 252 of longitudinal bar 135 is positioned within tongue receiving portion 465 of cover 143. Likewise, tongue portion 152 of longitudinal bar 137 is positioned within tongue receiving portion 466 of cover 143. In this manner, cover 143 conceals any visible gaps between longitudinal bars 135 and 137 and brace 140, while also providing mullion assembly 65 with an aesthetically pleasing outer appearance. The smooth, pre-painted front surface portions 168 and 268 of longitudinal bars 135 and 137, as well as front face portion 468 of cover 143, provide a uniform sealing surface for door seals 105 and 130. In a preferred embodiment, door seals 105 and 130 actually constitute magnetic door seals.

Based on the above, it should be readily apparent that the various pieces of the mullion assembly of the present invention can be readily interconnected and attached to the refrigerator cabinet. With the inclusion of brace 140, a significantly stronger mullion is established, while still providing for ease of assembly and advantageous aesthetic qualities. Although described with reference to a preferred embodiment of the invention, it should be readily understood that various changes and/or modifications can be made to the invention without departing from the spirit thereof. For instance, although the mullion assembly is mainly made of steel in the preferred embodiment, it is understood that other types of materials could be utilized without departing from the invention. In addition, although cosmetic cover 143 is shown having a snap-type connection with brace 140, other methods could be used to secure cover 143 to brace 140, such as screws, adhesive, welding or the like. In general, the invention is only intended to be limited by the scope of the following claims.

We claim:

1. A refrigerator comprising:

a cabinet defining laterally spaced fresh food and freezer compartments separated by a fore-to-aft extending divider wall, with each of the fresh food and freezer compartments having varying width sections and an open frontal zone;

fresh food and freezer doors pivotally mounted to the cabinet between open and closed positions for accessing and sealing the fresh food and freezer compartments respectively; and a multi-piece mullion assembly positioned between the fresh food and freezer compartments, said mullion assembly comprising a first elongated mullion member, a second elongated mullion member, and a brace including first and second leg portions interconnected by a laterally extending portion, said first and second mullion members being laterally and vertically offset in relation to one another, wherein said first and second mullion members at least partially overlap the first and second portions of the brace respectively and include connecting members that provide snap-fit connections between the first and second mullion members and the brace securing the first and second mullion members to the brace to form the mullion assembly.

2. The refrigerator according to claim 1, wherein each of the first and second mullion members includes a lip portion that at least partially overlaps the laterally extending portion of the brace.

3. The refrigerator according to claim 2, wherein the mullion assembly further comprises a cosmetic cover.

4. The refrigerator according to claim 3, wherein the cosmetic cover includes a body portion having first and second lip receiving recesses, the lip receiving recesses sandwiching the lip portions of the first and second mullion members between the cosmetic cover and the brace.

5. The refrigerator according to claim 4, wherein the cosmetic cover includes at least one snap-fit member securing the cover to the brace.

6. The refrigerator according to claim 5, wherein the snap-fit member includes at least one tab extending substantially perpendicularly from the body portion of the cosmetic cover and engaging the brace.

7. The refrigerator according to claim 1, wherein each of the first and second mullion members includes a body portion, as well as first and second wall portions extending substantially perpendicularly from the body portion, with said first and second wall portions defining a laterally opening channel.

* * * * *